US006661166B2

(12) United States Patent
Yamauchi et al.

(10) Patent No.: US 6,661,166 B2
(45) Date of Patent: Dec. 9, 2003

(54) ELECTRON GUN AND CATHODE-RAY TUBE

(75) Inventors: Masahide Yamauchi, Kyoto (JP); Takashi Itoh, Amagasaki (JP); Koji Fujii, Kashihari (JP); Keisuke Koga, Kyoto (JP); Toru Kawase, Katano (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 22 days.

(21) Appl. No.: 10/163,146

(22) Filed: Jun. 4, 2002

(65) Prior Publication Data

US 2002/0190631 A1 Dec. 19, 2002

(30) Foreign Application Priority Data

Jun. 18, 2001 (JP) ..... 2001-182775

(51) Int. Cl.[7] ..... H01J 1/62

(52) U.S. Cl. ..... 313/447; 313/348; 313/412; 313/449

(58) Field of Search ..... 313/412, 414, 313/348, 389, 446, 447, 449, 454

(56) References Cited

U.S. PATENT DOCUMENTS 3,946,265 A * 3/1976 Verhoeven ..... 313/390
4,076,994 A * 2/1978 Anderson ..... 313/422
4,254,360 A * 3/1981 Haven ..... 313/395
4,866,335 A * 9/1989 Cho ..... 313/412

FOREIGN PATENT DOCUMENTS

JP 8-106848 4/1996
JP 9-82248 A 3/1997

* cited by examiner

*Primary Examiner*—Tan Ho
(74) *Attorney, Agent, or Firm*—Merchant & Gould, P.C.

(57) ABSTRACT

A cathode includes emitter tips provided on a substrate, a gate electrode with an electric field formed between the gate electrode and the emitter tips, and terminals and leads for supplying voltages to the emitter tips and the gate electrode, respectively. A shield electrode further is provided between the cathode and a control electrode, and the shield electrode has a cylindrical projecting portion projecting toward the cathode, through which electron beams pass. The disturbance of an electric field by the leads influences the electron beams; however, this can be prevented by the projecting portion. Because of this, even if the size of the cathode is reduced, the distortion of an electron beam spot on a phosphor screen can be reduced. As a result, a cathode-ray tube with high resolution can be provided at a low cost.

4 Claims, 7 Drawing Sheets

FIG. 6A
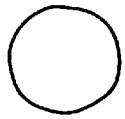
FIG. 6B
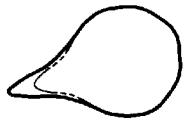
PRIOR ART
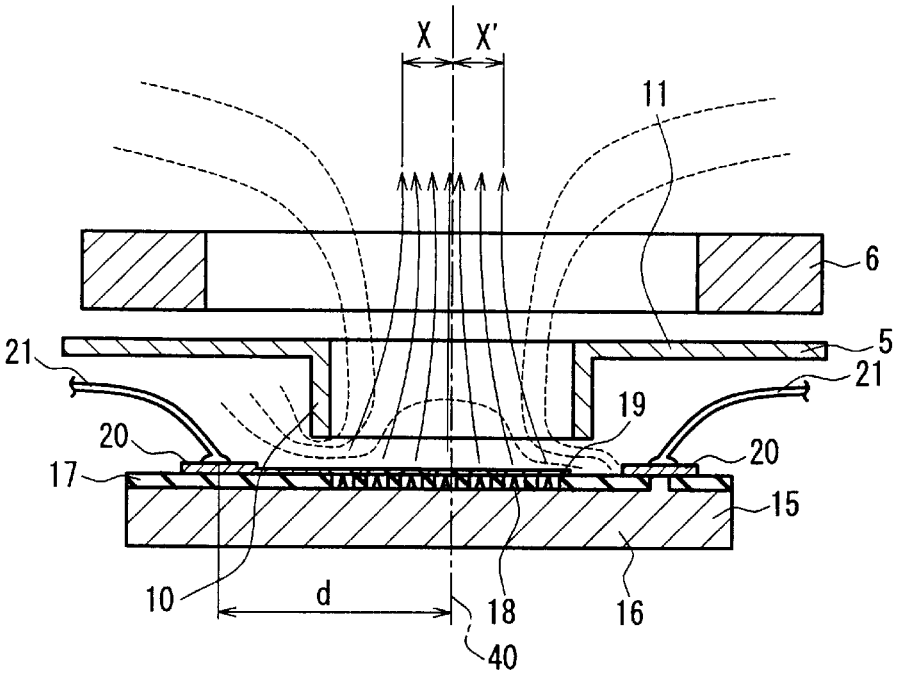
FIG. 7

ELECTRON GUN AND CATHODE-RAY TUBE

BACKGROUND OF THE INVENTION

1. Field of the Invention

The present invention relates to an electron gun, and in particular, to an electron gun characterized by a configuration of a field-emission type cold cathode and a cathode-ray tube using the same.

2. Description of the Related Art

FIGS. 9 to 11 show a conventional example of a cathode-ray tube apparatus equipped with a field-emission type cold cathode described in JP 9(1997)-82248 A. As shown in FIG. 9, an electron gun is mounted in a neck portion of the cathode-ray tube apparatus, and a field-emission type cold cathode 22 is provided in the electron gun. As shown in FIG. 10, the field-emission type cold cathode 22 is composed of a cold cathode 24 attached to a ceramic substrate 23, wiring from an emitter area 25 of the cold cathode 24, a bonding pad 26 for supplying an electric potential to the wiring, and a bonding wire 28 for electrically connecting the bonding pad 26 to an electrode 27. A focusing electrode 29 having an electron beam passage hole 30 is disposed downstream of the emitter area 25. As shown in FIG. 11, the emitter area 25 is composed of a silicon substrate 31, an insulating layer 32, a gate electrode 33, a plurality of hollows 34, and a plurality of emitters 35.

The thickness of the insulating layer 32 is about 1 $\mu$m, the aperture diameter of the gate electrode 33 is about 1 $\mu$m, and the tip end of each emitter 35 is pointed to be about 20 nm. The gate electrode 33 is supplied with a voltage of about 50 V with respect to the emitters 35. Because of this, a strong electric field (2 to $5\times10^7$ V/cm or more) is generated between the tip ends of the emitters 35 and the gate electrode 33, whereby electrons are emitted from the tip ends of the emitters 35. By arranging a number of minute cold cathodes with such a configuration in an array on the substrate 31, a flat cathode releasing a large current can be constituted.

The above-mentioned configuration is formed by a minute processing technique using a so-called semiconductor process. By mounting minute cold cathodes at high density, the cathode current density can be made 5 to 10 times that of a conventional hot cathode.

An attempt has been made to obtain a cathode-ray tube apparatus with high resolution by utilizing a high cathode current density to achieve a high density of electron beams and reduce the size of an electron beam spot formed on a phosphor screen of the cathode-ray tube apparatus.

In a cold cathode produced by such a minute processing technique, it is desired to decrease the production cost for a cold cathode by further reducing the size of the silicon substrate 31 of a cold cathode, thereby increasing the number of silicon chips to be produced from one wafer.

However, in the case where the size of the silicon substrate 31 is reduced, the emitter area 25 and the bonding pad 26 are disposed close to each other, and the bonding wire 28 to be arranged on the bonding pad 26 and the emitter area 25 also are disposed close to each other. Since the bonding wire 28 is disposed to be non-axially-symmetrical with respect to the emitter area 25, an electric field formed in the vicinity of the emitter area 25 is distorted to be non-axially-symmetrical. Therefore, electron beams passing through the electron beam passage hole 30 also are distorted to be non-axially-symmetrical, and the shape of an electron beam spot formed on a phosphor screen of the cathode-ray tube also is distorted. In the case where an electron beam spot is distorted, the resolution of the cathode-ray tube apparatus is degraded.

In order to solve the above-mentioned problem, JP 8(1996)-106848 A describes a cold cathode in which a cathode electrode having a plurality of electron-emission points, a gate electrode, and a focusing electrode are stacked while being insulated from each other, wherein a shielding electrode covering a feed terminal portion is opposed to and spaced from the focusing electrode. This configuration is different from the above-mentioned cold cathode configuration shown in FIGS. 10 and 11 to which the present invention is directed, in that the focusing electrode is stacked. However, in the configuration described in JP 8(1996)-106848 A, an attempt is made to prevent an electric field generated by a bonding terminal and wiring from influencing the track of electrons. Thus, the present invention and the subject matter of JP 8(1996)-106848 A share a common problem to be solved.

However, in the case where a shielding electrode is disposed in the above-mentioned cold cathode configuration to which the present invention is directed in a similar manner to that in JP 8(1996)-106848 A, since the bonding wire is arranged three-dimensionally, the distance between the cathode and the shielding electrode becomes large. Consequently, even if the shielding electrode is provided, the effect of minimizing the non-axial-symmetry of an electric field from the cathode to the aperture of the shielding electrode is small. Furthermore, when the bonding wire is disposed closer to the emitter area in connection with miniaturization of a cathode as described above, providing the shielding electrode has no effect on the disturbance of an electric field in the vicinity of the emitter area.

SUMMARY OF THE INVENTION

Therefore, with the foregoing in mind, it is an object of the present invention to provide an electron gun and a cathode-ray tube capable of realizing high resolution without causing any distortion of an electron beam spot due to size reduction of a cathode at a low cost.

An electron gun of the present invention includes a cathode and a control electrode, wherein the cathode includes emitter tips provided on a substrate and supplied with a predetermined voltage, a gate electrode with an electric field formed between the gate electrode and the emitter tips, a terminal and a lead for supplying a voltage to the emitter tips, and a terminal and a lead for supplying a voltage to the gate electrode. A shield electrode further is provided between the cathode and the control electrode, and the shield electrode has a cylindrical projecting portion projecting toward the cathode, through which electron beams pass.

Herein, the term "cylindrical projecting portion" refers to a column body provided with a hollow portion through which an electron beam can pass, and its top and bottom surfaces do not necessarily have the same shape and size. Examples of the shape of the cylindrical projecting portion include a columnar shape in which generating lines are parallel to each other, a shape obtained by cutting the surface of a cone, in which generating lines pass through one point (apex), with two planes crossing all the generating lines and being parallel to each other, a bobbin shape in which a central portion is thin, etc.

According to the above configuration, the cylindrical projecting portion is provided so as to be integral with the shield electrode between the cathode and the shield electrode, whereby electron beams passing therebetween can be shielded by the projecting portion. Therefore, the electron beams are not influenced by an electric field generated by bonding wires. Furthermore, an electric field formed in the projecting portion is axially-symmetrical, so that the cross-section of an electron beam can be formed in a substantially perfect circle. Because of this, an electron beam spot on a phosphor screen is not distorted, and the cathode can be miniaturized.

Furthermore, it is preferable that an inner diameter of a tip end of the projecting portion is substantially equal to an inner diameter of a base thereof.

According to the above preferable configuration, the diameter of the electron beams further can be decreased in the vicinity of the cathode. Therefore, the distortion of an electron beam spot can be prevented, and the size thereof can be reduced.

Furthermore, it is preferable that an inner diameter of a tip end of the projecting portion is larger than an inner diameter of a base thereof.

According to the above preferable configuration, the diameter of electron beams further can be decreased in the vicinity of the cathode. Therefore, the distortion of an electron beam spot can be prevented, and the size thereof can be reduced.

Furthermore, a cathode-ray tube of the present invention includes a glass envelope composed of a front panel and a funnel, a phosphor screen formed on an inner surface of the front panel, and an electron gun disposed in a neck portion of the funnel, wherein the electron gun is the above-mentioned electron gun of the present invention.

According to this configuration, a cathode-ray tube capable of realizing high resolution without causing any distortion of an electron beam spot involved in size reduction of the cathode can be provided at a low cost.

These and other advantages of the present invention will become apparent to those skilled in the art upon reading and understanding the following detailed description with reference to the accompanying figures.

BRIEF DESCRIPTION OF THE DRAWINGS

FIG. 6A shows the shape of an electron beam spot in Embodiment 1 according to the present invention.

FIG. 6B shows the shape of a conventional electron beam spot.

FIG. 7 is a cross-sectional view showing a configuration of the vicinity of a cathode of an electron gun and an electron beam track in Embodiment 2 according to the present invention.

DESCRIPTION OF THE PREFERRED EMBODIMENTS

Hereinafter, the present invention will be described by way of embodiments with reference to the drawings.

Embodiment 1

Figure 3:
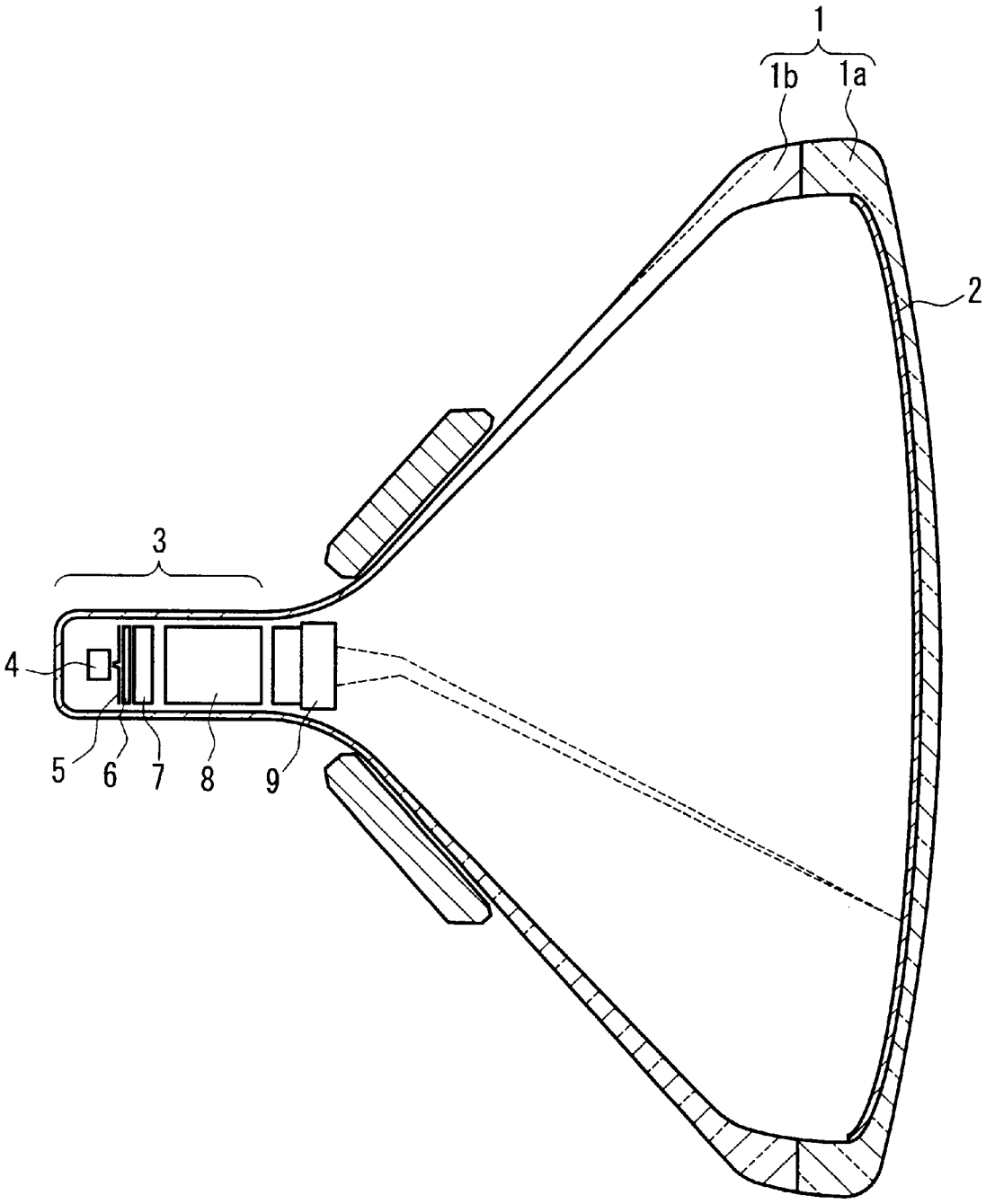
FIG. 3 is a cross-sectional side view of a cathode-ray tube of the present invention.

As shown in FIG. 3, a cathode-ray tube of Embodiment 1 according to the present invention includes a glass envelope 1 composed of a front panel 1*a* and a funnel 1*b*, a phosphor screen 2 formed on an inner surface of the front panel 1*a*, and an electron gun disposed in a neck portion 3 of the funnel 1*b*. The electron gun is composed of a cathode body 4, and a shield electrode 5, a control electrode 6, an accelerating electrode 7, a focusing electrode 8, and a final accelerating electrode 9 disposed downstream of the cathode body 4 in this order.

Figure 1:
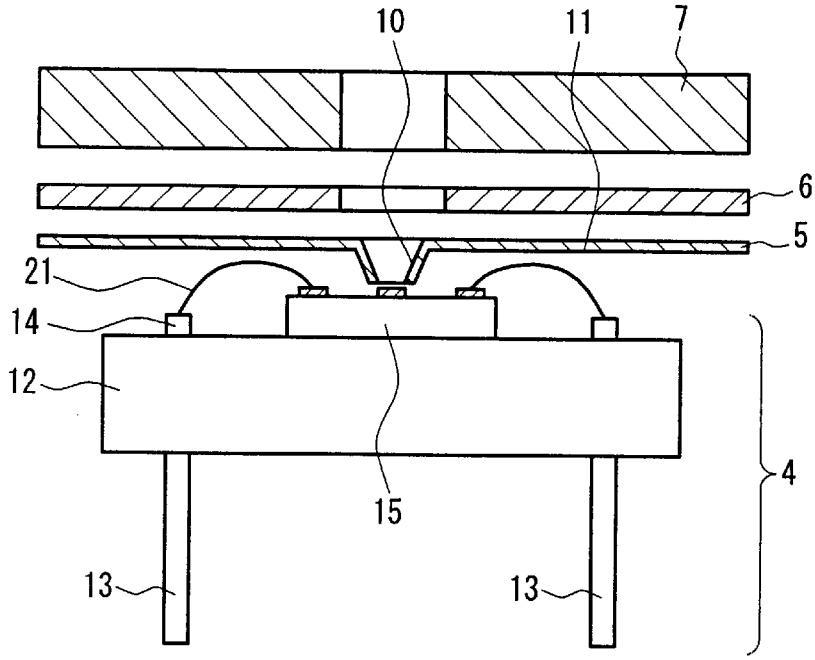
FIG. 1 is a partial cross-sectional side view showing a configuration of a cathode body of an electron gun of the present invention and electrodes in the vicinity thereof.

FIG. 1 shows a side view of the cathode body 4, and a cross-sectional view of the shield electrode 5, the control electrode 6, and the accelerating electrode 7. The cathode body 4 includes an insulating substrate 12, a plurality of voltage supply leads 13, voltage supply terminals 14 connected to the voltage supply leads 13, and a cathode 15 disposed on the insulating substrate 12. The shield electrode 5 is composed of a substantially cylindrical projecting portion 10 projecting toward the cathode 15, for surrounding electron beams, and a flat portion 11. The control electrode 6 and the accelerating electrode 7 have apertures for electron beams to pass therethrough.

Figure 2:
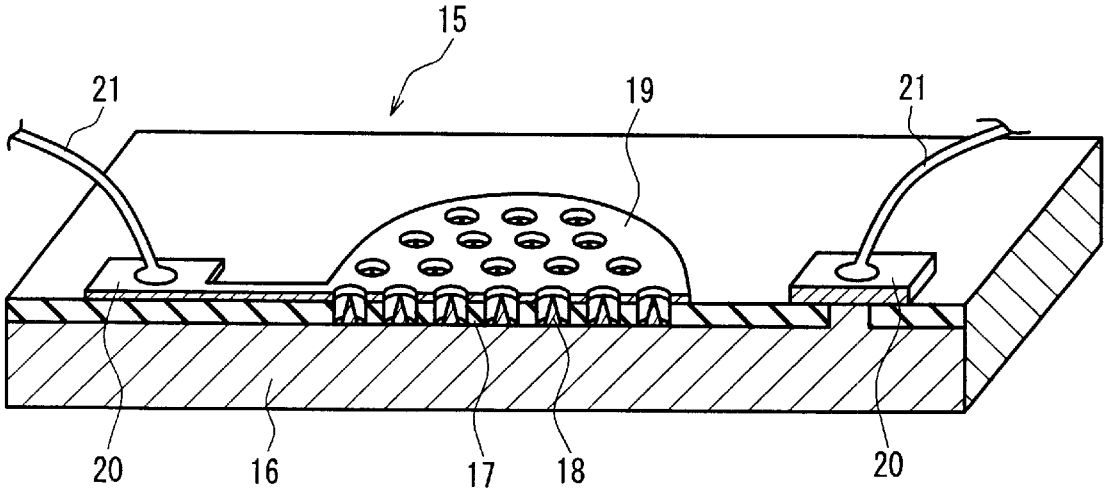
FIG. 2 is a cross-sectional perspective view of a cathode of the electron gun of the present invention.
Figure 10:
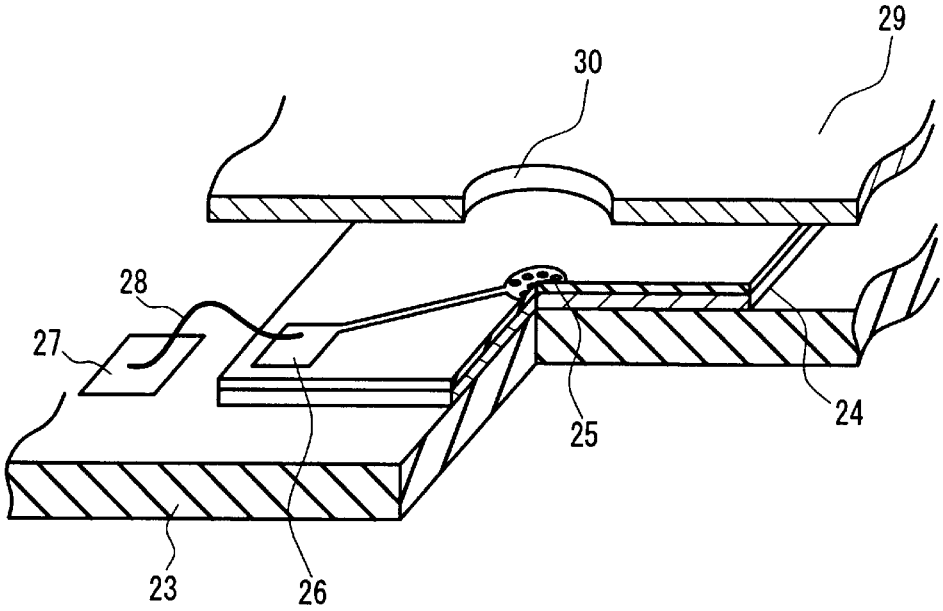
FIG. 10 PRIOR ART
FIG. 10 is a cross-sectional perspective view of a conventional cold cathode.
Figure 11:
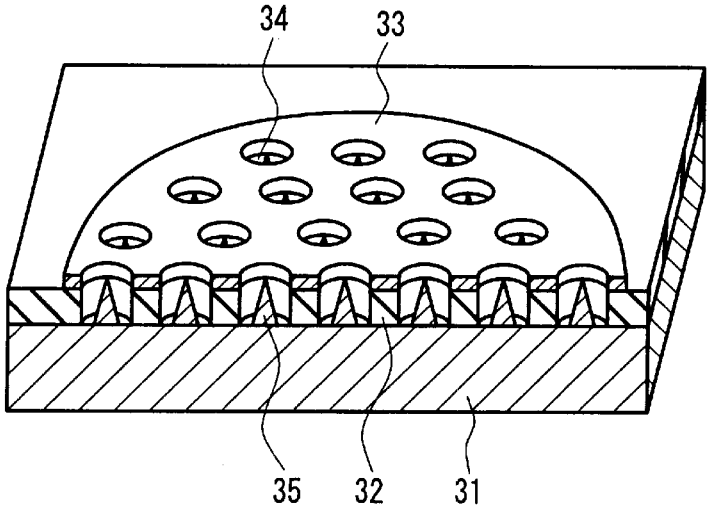
FIG. 11 PRIOR ART
FIG. 11 is a cross-sectional perspective view of an emitter region of a conventional cold cathode.

FIG. 2 is a cross-sectional perspective view showing the cathode 15 in an enlarged state. The cathode 15 includes conical emitter tips 18 (corresponding to the emitters 35 in FIG. 11) whose tip ends are pointed, provided as a plurality in number on a substrate 16, an insulating layer 17 formed on the substrate 16 excluding the emitter tips 18 and the vicinity thereof, and a gate electrode 19 (corresponding to the gate electrode 33 in FIG. 11) provided with a number of apertures opposed to the emitter tips 18. On the surface of the cathode 15, two bonding terminals 20 (corresponding to the bonding pad 26 in FIG. 10) for supplying different voltages to the emitter tips 18 and the gate electrode 19 are provided. The two bonding terminals 20 are connected to two voltage supply terminals 14 provided on the cathode body 4 via leads 21 (corresponding to the bonding wire 28 in FIG. 10).

Next, an example of the present embodiment will be described.

The cathode 15 has a size of 1 mm per side and a thickness of 0.4 mm. An emitter region (region of the gate electrode 19 in FIG. 2) in which the emitter tips 18 are distributed has a circular shape with a diameter of 0.2 mm. Each bonding terminal 20 has a size of 0.2 mm per side, and is formed at a position about 0.1 mm away from the end facet of the cathode 15. Each emitter tip 18 has a conical shape with a bottom surface diameter of about 0.4 $\mu$m and a height of about 1 $\mu$m, and the tip ends thereof are pointed to a radius of about 20 nm. The gate electrode 19 has a circular shape with a diameter of 0.2 mm, and the diameter of apertures opposed to the emitter tips 18 is 0.9 $\mu$m. About 10,000 pairs of the emitter tips 18 and the apertures of the gate electrode 19 are formed in the emitter region with a diameter of 0.2 mm so that a distance between adjacent pairs becomes 2 $\mu$m.

The tip ends of the emitter tips 18 and the gate electrode 19 are positioned substantially on the same surface, and a strong electric field is formed at the tip ends of the emitter tips 18.

The cathode substrate 16 and the emitter tips 18 are made of silicon (Si). The insulating layer 17 is made of $SiO_2$. The gate electrode 19 is made of niobium (Nb). The bonding terminals 20 are made of aluminum (Al). The bonding terminals 20 and the voltage supply terminals 14 are connected to each other by ball bonding, using the leads 21 made of a gold wire with a diameter of 15 $\mu$m.

The ball bonding is a method in which the cathode body 4 is heated so that the bonding terminals 20 reach about 100° C., and the ends of the leads 21 are attached to the bonding terminals 20 under pressure simultaneously with ultrasonic vibration, whereby the bonding terminals 20 and the leads 21 are connected to each other. The lead 21 connected to the bonding terminal 20 has an arc shape that is convex toward the shield electrode 5, and the other end of the lead 21 is connected to the voltage supply terminal 14 similarly. At this time, the highest portion of the arch-shaped lead 21 reaches a position of about 0.1 mm from the surface of the cathode 15. This highest portion is caused by the ball-shaped connection portion of the lead 21 formed during ball bonding and the connection angle of the lead 21. Thus, it is difficult to prescribe the highest portion to be about 0.1 mm or less.

The emitter tips 18 are supplied with a voltage of about 10 to 50 V in accordance with an electron beam current to be output, via the voltage supply lead 13, the voltage supply terminal 14, the lead 21, and the bonding terminal 20 of the cathode body 4. Furthermore, the gate electrode 19 similarly is supplied with a constant voltage of 85 V via the voltage supply lead 13, the voltage supply terminal 14, the lead 21, and the bonding terminal 20.

In the shield electrode 5, the thickness of the flat portion 11 is 0.12 mm. The projecting portion 10 has a length of 0.08 mm. The inner diameter of the tip end (on the side of the cathode 15) of the projecting portion 10 is 0.2 mm, and the outer diameter thereof is 0.27 mm. The inner diameter of the base (on the side of the flat portion 11) of the projecting portion 10 is 0.26 mm, and the outer diameter thereof is 0.33 mm.

The aperture diameter of the control electrode 6 is 0.8 mm, and the aperture diameter of the accelerating electrode 7 is 1 mm. The focusing electrode 8 and the final accelerating electrode 9 effectively have an aperture diameter of about 10 mm. All the electrodes are made of stainless steel. An electric potential is supplied to each electrode as follows: 30 kV for the final accelerating electrode 9, 8 kV for the focusing electrode 8, 700 V for the accelerating electrode 7, 0 V for the control electrode 6, and 40 V for the shield electrode 5. The material, shape, and voltage of each electrode are varied depending upon the size, use, and required performance of the cathode-ray tube.

Next, an operation of the electron gun of the present invention will be described.

When the emitter tips 18 are supplied with a voltage of 50 V, electrons are not emitted from the emitter tips 18 (so-called cut-off state). As the electric potential of the emitter tips 18 is decreased, the electric field between the gate electrode 19 and the emitter tips 18 is increased, whereby electrons are emitted from the tip ends of the emitter tips 18. The current amount during emission of electrons depends upon the voltage of the emitter tips 18. When the voltage of the emitter tips 18 is decreased, an emission current amount is increased. Substantially the same amount of electrons are emitted from about 10,000 emitter tips 18 formed in the emitter region. Therefore, electrons are emitted at substantially uniform current density over the entire emitter region.

Electron beams emitted from the emitter region pass through the inside of the projecting portion 10 of the shield electrode 5. Then, the electron beams are focused by the control electrode 6 and accelerated by the accelerating electrode 7 to be guided to the focusing electrode 8. The electron beams form an electron beam spot on a phosphor screen by an electrostatic lens formed by the focusing electrode 8 and the final accelerating electrode 9.

In order to obtain high resolution in the cathode-ray tube, it is desirable to reduce the size of an electron beam spot formed on a phosphor screen and to form the beam spot in a perfect circle without any distortion. Thus, the electron beam passage holes of the respective electrodes constituting the electron gun are formed substantially in a circular shape, whereby an electrostatic lens, which is substantially symmetrical with respect to the axis through which the electron beams pass, is formed. However, as described above, in the cathode body 4, the emitter tips 18 and the gate electrode 19 are supplied with different voltages of 10 to 50 V and 85V, respectively. Two leads 21 with different potentials are present in the vicinity of the emitter region, so that a non-axially-symmetrical electric field is formed.

In the case where the leads 21 are present at a position away from the emitter region as in the conventional example, the influence of a non-axially-symmetrical electric field by the leads 21 can be reduced to some degree by covering the upper portions of the leads 21 with a flat shielding electrode. However, in the case where the size of the cathode 15 is reduced to dispose the emitter region close to the leads 21 as in the present embodiment, electron beams are influenced by a non-axially-symmetrical electric field, and an electron beam spot on a phosphor screen is distorted greatly.

Figure 4:
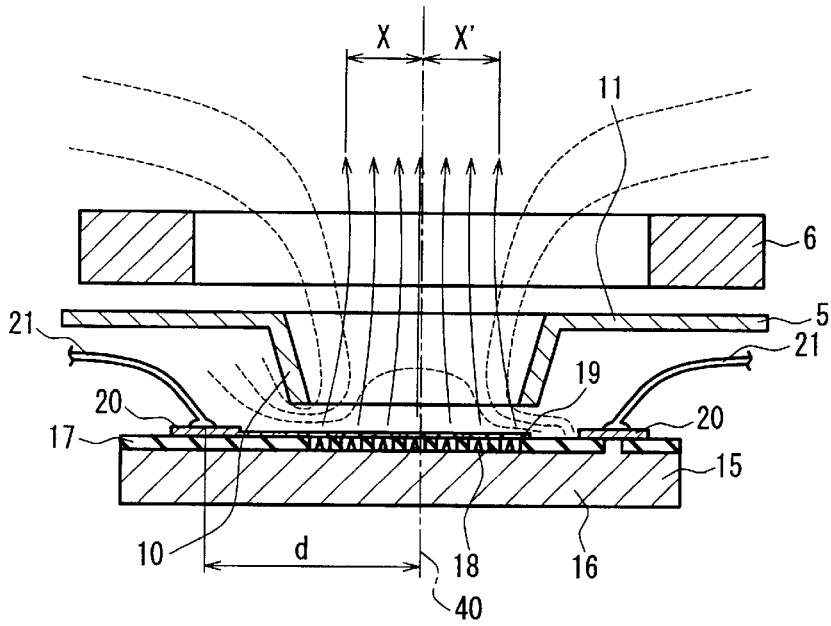
FIG. 4 is a cross-sectional view showing the configuration of the vicinity of a cathode of an electron gun and an electron beam track in Embodiment 1 according to the present invention.
Figure 5:
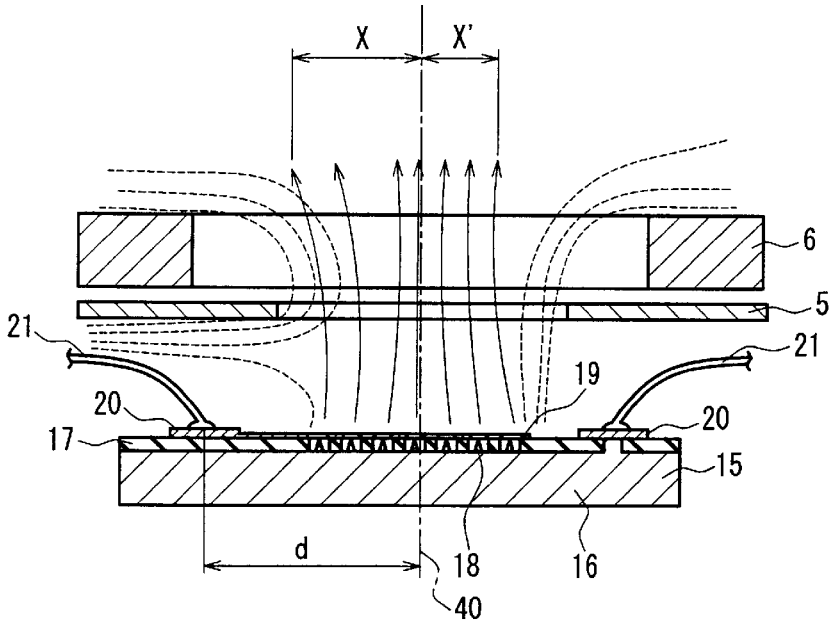
FIG. 5 PRIOR ART
FIG. 5 is a cross-sectional view showing a configuration of the vicinity of a cathode of a conventional electron gun and an electron beam track.

FIGS. 4 and 5 are side cross-sectional views of the cathode 15, the shield electrode 5, and the control electrode 6. An alternate long and short dash line 40 represents a line (substantially corresponding to a tube axis of the cathode-ray tube) passing through the center of the emitter region. Broken lines represent an equipotential. A bundle of arrows represents the flow of electron beams, and "d" represents the distance from the center of the emitter region to the end of the lead 21 on the bonding terminal 20. Furthermore, the distance from the alternate long and short dash line 40 passing through the center of the emitter region to an edge of the left side (i.e., the side of the bonding terminal 20 with the same potential as that of the gate electrode 19) of electron beams is represented by "x", and the distance from the alternate long and short dash line 40 to an edge of the right side (i.e., the side of the bonding terminal 20 with the same potential as that of the emitter tips 18) of electron beams is represented by "x'".

When the case in the presence of the projecting portion 10 on the shield electrode 5 (FIG. 4) is compared with the case in the absence of the projecting portion 10 on the shield electrode 5 (FIG. 5), the following is understood. In the absence of the projecting portion 10, the difference in track of electron beams (defined as the difference between the distances "x" and "x'") is increased. In the presence of the projecting portion 10, there is substantially no difference in track of electron beams. The reasons for this are as follows: as is apparent from an equipotential distribution, due to the presence of the projecting portion 10, the disturbance of an electric field by the leads 21 does not influence the electron beams, and the potential distribution in the projecting portion 10 becomes substantially axially-symmetrical with respect to the alternate long and short dash line 40.

FIGS. 6A and 6B show the results obtained from the actual observation of the shape of an electron beam spot on a phosphor screen by the inventors, wherein FIG. 6A shows the case in the presence of the projecting portion 10, and FIG. 6B shows the case in the absence of the projecting portion 10. It is understood that, by providing the projecting portion 10, the distortion of an electron beam spot is minimized, and the electron beam spot becomes close to a perfect circle. Thus, by minimizing the distortion of an electron beam, the resolution of the cathode-ray tube can be enhanced.

As described above, in the electron gun and the cathode-ray tube of the present invention, by providing the shield electrode 5 having the cylindrical projecting portion 10 for shielding a region between the leads 21 for supplying voltages to the emitter tips 18 and the gate electrode 19 and the electron beams, even when the size of the cathode 15 is reduced, and the distance between the emitter region and the leads 21 (more specifically, distance "d" in FIGS. 4 and 5) is decreased, high resolution can be realized without causing any distortion in an electron beam spot.

Furthermore, the cathode 15 used in the present invention is produced from a silicon wafer by a semiconductor process. Therefore, as the size of the cathode 15 is smaller, the number of cathodes to be produced from one silicon wafer is increased. Therefore, as the size of the cathode is reduced, the cost therefor can be lowered. More specifically, according to the present invention, the cost for the cathode body 4 can be reduced substantially by significantly reducing the size of the cathode 15 as compared with the conventional example. Therefore, a cathode-ray tube apparatus capable of realizing high resolution can be provided at a low cost.

Embodiment 2

Hereinafter, Embodiment 2 of the present invention will be described.

Embodiment 2 is different from Embodiment 1 in that, regarding the aperture diameter of the projecting portion 10 of the shield electrode 5, the inner diameter of the tip end (i.e., the side of the cathode 15) and the inner diameter of the base (i.e., the side of the flat portion 11) have substantially the same size.

FIG. 7 shows a side enlarged cross-sectional view of the cathode 15, the shield electrode 5, and the control electrode 6 in the present embodiment. An alternate long and short dash line, broken lines, and arrows represent the center line of the emitter region, the equipotential, and the bundle of electron beams in the same way as in FIGS. 4 and 5.

In the present embodiment, in the same way as in Embodiment 1, the projecting portion 10 is present so as to cover electron beams in the vicinity of the cathode 15, whereby the distortion of an electron beam spot caused by the non-symmetrical electric field of the leads 21 can be minimized. Furthermore, since the projecting portion 10 has a cylindrical shape, a stronger focusing electrostatic lens can be formed in the vicinity of the shield electrode 5, compared with Embodiment 1 in which the inner diameter of the projecting portion 10 is enlarged toward the base. Because of this, a bundle of electron beams output from the cathode 15 can be reduced in size in the vicinity of the control electrode 6, and a smaller electron beam spot can be formed.

The following is an example. The projecting portion 10 has a length of 0.08 mm. The inner diameter of the projecting portion 10 is 0.2 mm both at a tip end and a base. The outer diameter thereof is 0.27 mm. The thickness of the flat portion 11 of the shield electrode 5 is 0.12 mm. The remaining portions of the cathode, the configuration of the electron gun, material, an applied voltage, and the like are similar to those of Embodiment 1.

Embodiment 3

Next, Embodiment 3 of the present invention will be described.

Embodiment 3 is different from the above-mentioned two embodiments in that, regarding the aperture diameter of the projecting portion 10 of the shield electrode 5, the inner diameter of the tip end is set to be larger than that of the base. More specifically, contrary to Embodiment 1, the projecting portion 10 is narrowed toward the base.

Figure 8:
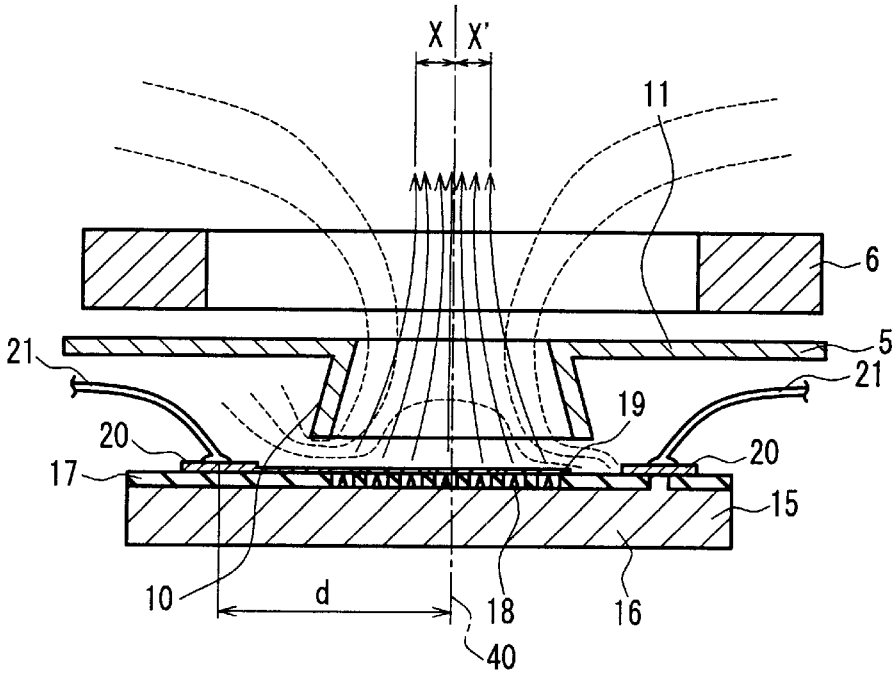
FIG. 8 is a cross-sectional view showing a configuration of the vicinity of a cathode of an electron gun and an electron beam track in Embodiment 3 according to the present invention.
Figure 9:
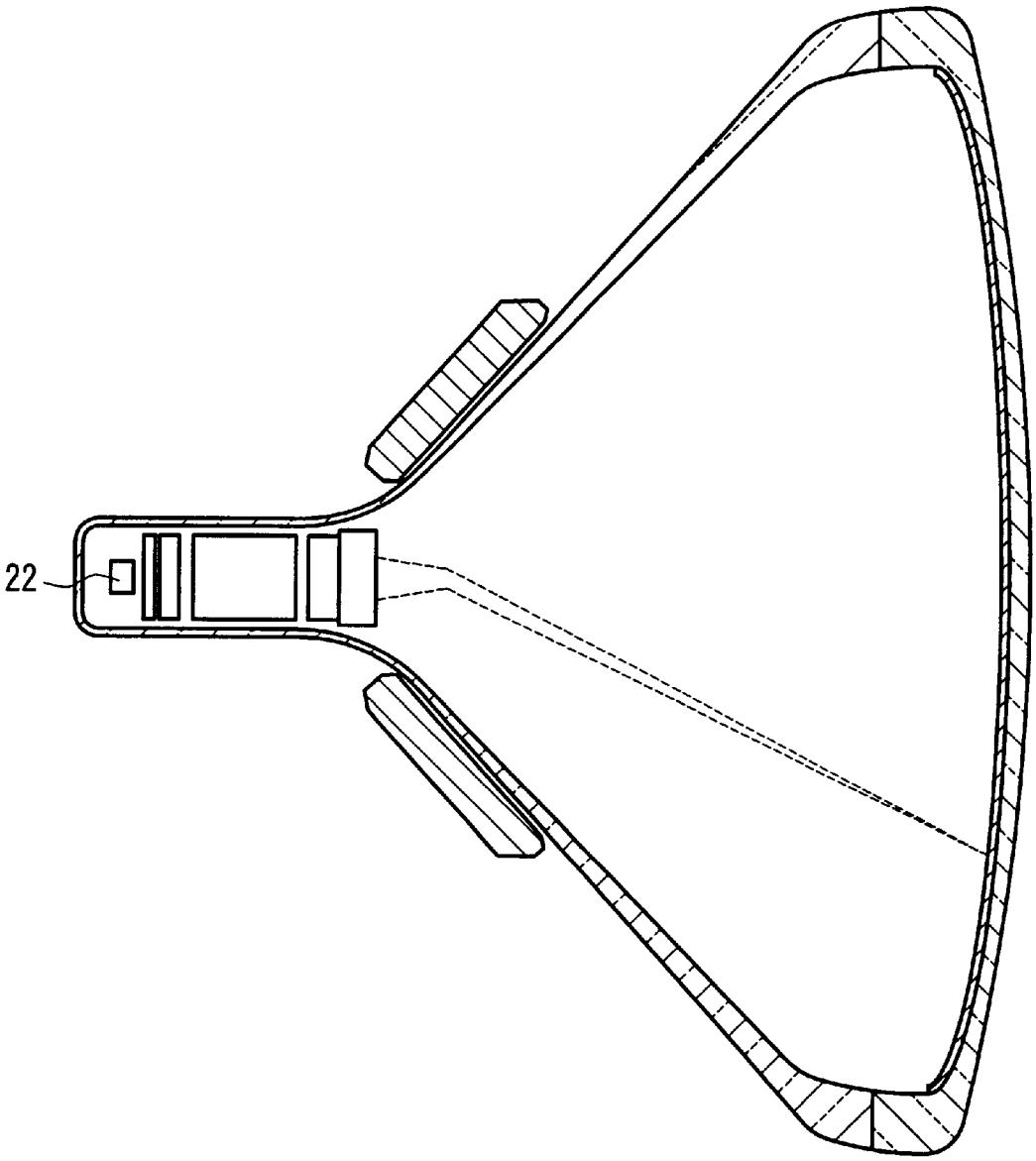
FIG. 9 PRIOR ART
FIG. 9 is a side cross-sectional view of a conventional cathode-ray tube.

FIG. 8 shows a side enlarged cross-sectional view of the cathode 15, the shield electrode 5, and the control electrode 6 in the present embodiment. An alternate long and short dash line, broken lines, and arrows represent the center line of the emitter region, the equipotential, and the bundle of electron beams in the same way as in FIGS. 4 and 5.

In the present embodiment, compared with Embodiment 2, the equipotential distribution in the projecting portion 10 of the shield electrode 5 becomes further dense, and a stronger focusing electrostatic lens can be formed in the vicinity of the shield electrode 5. Because of this, a bundle of electron beams emitted from the cathode 15 can be reduced in size in the vicinity of the control electrode 6, whereby a smaller electron beam spot can be formed.

The following is an example. The projecting portion 10 has a length of 0.08 mm. The inner diameter of the tip end is 0.2 mm, and the outer diameter thereof is 0.27 mm. The inner diameter of the base is 0.15 mm, and the outer diameter thereof is 0.22 mm. The thickness of the flat portion 11 is 0.12 mm. The remaining portions are similar to those of the other embodiments.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. An electron gun comprising a cathode and a control electrode, wherein the cathode includes emitter tips provided on a substrate and supplied with a predetermined voltage, a gate electrode with an electric field formed between the gate electrode and the emitter tips, a terminal and a lead for supplying a voltage to the emitter tips, and a terminal and a lead for supplying a voltage to the gate electrode, and a shield electrode further is provided between the cathode and the control electrode, and the shield electrode has a substantially cylindrical projecting portion projecting toward the cathode, through which electron beams pass.

2. An electron gun according to claim 1, wherein an inner diameter of a tip end of the projecting portion is substantially equal to an inner diameter of a base thereof.

3. An electron gun according to claim 1, wherein an inner diameter of a tip end of the projecting portion is larger than an inner diameter of a base thereof.

4. A cathode-ray tube comprising a glass envelope composed of a front panel and a funnel, a phosphor screen formed on an inner surface of the front panel, and an electron gun disposed in a neck portion of the funnel, wherein the electron gun is the electron gun of claim 1.

* * * * *